US006145978A

United States Patent [19]

Kato et al.

[11] Patent Number: 6,145,978

[45] Date of Patent: Nov. 14, 2000

[54] PRINTING METHOD AND PRINTING APPARATUS USING INK AND TREATMENT LIQUID

[75] Inventors: Minako Kato, Yokohama; Jiro Moriyama, Kawasaki; Miyuki Fujita, Tokyo, all of Japan

[73] Assignee: Canon Kabushiki Kaisha, Tokyo, Japan

[21] Appl. No.: 08/985,736

[22] Filed: Dec. 5, 1997

[30] Foreign Application Priority Data

Dec. 10, 1996 [JP] Japan ..... 8-329648

[51] Int. Cl.[7] ..... B41J 2/01

[52] U.S. Cl. ..... 347/101

[58] Field of Search ..... 347/20, 21, 22, 347/36, 98, 95, 100, 101

[56] References Cited

U.S. PATENT DOCUMENTS 5,898,443 4/1999 Yoshino et al. ..... 347/19

FOREIGN PATENT DOCUMENTS 703087 3/1996 European Pat. Off. .
726148 8/1996 European Pat. Off. .
726155 8/1996 European Pat. Off. .
726158 8/1996 European Pat. Off. .

*Primary Examiner*—Arthur T. Grimley
*Assistant Examiner*—Hoang Ngo
*Attorney, Agent, or Firm*—Fitzpatrick, Cella, Harper & Scinto

[57] ABSTRACT

In the present invention, upon printing of an image on a printing medium by ejecting an ink for a treatment liquid ejected on the printing medium, by scanning the printing medium, a number of scan for the same region of the printing medium is judged, and ejection from a printing head is performed by variably setting the ejection amount of the treatment liquid in one scan by varying ratio of dots to be ejected versus all dots on the printing medium. Thus, deposition of mist or rebounded droplets on an ejection surface of an ink ejecting portion of the printing head can be avoided. By the present invention, pollution of the ejection surface of the printing head is avoided and thus reliability of ejection of the printing head is maintained.

34 Claims, 12 Drawing Sheets

EIG.5

INK EJECTION DATA

TWO-PATH DISTRIBUTING MASK

INK EJECTION DATA

TWO-PATH DISTRIBUTING MASK

INK EJECTION DATA

TREATMENT LIQUID EJECTION DATA

TWO-PATH DISTRIBUTING MASK

TREATMENT LIQUID EJECTION DATA

TWO-PATH DISTRIBUTING MASK

TREATMENT LIQUID EJECTION DATA

PRINTING METHOD AND PRINTING APPARATUS USING INK AND TREATMENT LIQUID

This application is based on patent application No. 08-329,648 filed Dec. 10, 1996 in Japan, the content of which is incorporated fereinto by reference.

BACKGROUND OF THE INVENTION

1. Field of the Invention

The present invention relates generally to a printing method and a printing apparatus. More specifically, the invention relates to a printing method and a printing apparatus for performing printing by ejecting a printing ink and a treatment liquid enhancing printing ability, through a printing head and depositing them on a printing medium.

2. Description of the Related Art

Conventionally, this kind of ink-jet printing method has been utilized in a business machine, such as a printer, a copy machine, a facsimile and so forth, and in an industrial production machine and so forth, in view of low noise, low running cost, easiness in down-sizing of an apparatus, easiness in color printing, and so on.

However, upon printing an image on a printing medium, so-called plain paper by a printing apparatus utilizing the ink-jet printing method, sufficient water resistance cannot be provided for the image and thus the image having high image fastness cannot be obtained. On the other hand, when an image to be printed is a color image, it has been difficult to achieve both of a high density image which does not cause feathering and an image which does not cause bleeding between different colors. Therefore, an image having high image fastness and high image quality cannot be obtained.

As a method for enhancing water resistance of the image, it has been recently practiced to employ an ink containing a coloring agent which is provided with a water-resistance. However, the water-resistance of such ink is still insufficient. Such ink is difficult to solve in a water after drying in principle, plugging of nozzle of the printing head can be caused easily. In order to prevent the apparatus from causing the plugging, a problem to make the construction of the apparatus complicate, can be encountered.

Also, conventionally, there are many publications disclosing technologies for enhancing image fastness of image printed by ejecting a treatment liquid, enhancing printing ability by causing chemical reaction with a printing ink, on the same position as a position where an ink droplet is deposited on the printing medium.

In Japanese Patent Laid-Open Publication No. 58-1288621 (1983), an ink-jet printing method, in which an image position to be printed by an ink is preliminarily identified and the printing ink and a treatment liquid are ejected to the identified position. In the disclosed printing method, printing is performed by ejecting the treatment liquid in advance of ejection of the printing ink, ejecting the treatment liquid overlaying the printing ink which is ejected in advance, or overlaying the printing ink over the treatment liquid ejected in advance and then overlaying the treatment liquid over the ejected printing ink.

In Japanese Patent Laid-Open Publication No. 8-07223 (1996), there has been proposed a method employing means for controlling ejecting the treatment liquid or not. In this method, whether the treatment liquid is to be ejected or not is arbitrarily selected by user, or depending upon a kind of the printing medium.

In Japanese Patent Laid-Open Publication No. 7-195823 (1994), there has been disclosed a method for smoothing the surface of the printing medium by ejecting a colorless treatment liquid in chemical reaction of two or three components on the surface of the printing medium. In this method, remaining amount of the colorless treatment liquid becomes small, printing is performed by scanning of a plurality of times as in the prior art.

However, these publications do not disclose a printing method, which can avoid pollution of an ink ejecting portion and improve reliability of the ink-jet printing apparatus.

On the other hand, in the ink-jet printing system, the following particular problems are encountered.

Namely, since printing is performed by ejecting ink droplets to the printing medium, such as a paper, OHP film and the like, fine ink droplets (mist), generated upon ejection of ink droplets, other than ink droplets depositing on the printing medium and ink droplets (rebounded ink droplets) once hit on the printing medium and then rebounded therefrom, and so on, may deposit on an ink ejection surface of the printing head. A large amount of ink droplets concentrically deposited around the ejection opening, or foreign matter, such as paper dust or the like, is deposited on the deposited ink droplets to interfere ejection from the ink ejecting portion to cause problems, such as deflecting of ink ejection direction from a desired direction (deflection of the ink droplets), causing failure of ejection of the ink droplets (ejection failure) or so on.

FIGS. 1A and 1B are explanatory illustrations showing a process of causing pollution of the surface of the ink ejecting portion by the rebounded ink droplet and the ink mist.

FIG. 1A is an explanatory illustration showing a manner of rebounding of the ink.

An ink ejection head 1 mounted on a carriage has an ink ejecting portion 2 for ejecting an A liquid La and an ink ejecting portion 3 for ejecting a B liquid Lb.

At first, according to movement of the carriage, the A liquid La is deposited on the printing paper 6 as a printing medium. Then, the A liquid La is sequentially spread over a wide area on the printing paper 6. Subsequently, the B liquid Lb is ejected at a certain relative speed in relation to the A liquid La spread over the printing paper 6. As a result, rebounded droplets $D_1$ of the A liquid La and rebounded droplets $D_2$ of the B liquid Lb are generated, and these rebounded droplets deposit on the ejection surface of the ink ejecting portions 2 and 3.

FIG. 1B is an explanatory illustration showing a manner of deposition of mist on the ejection surface.

A droplet of the A liquid ejected from the ink ejecting portion 2 is separated into main ink droplet Da and fine ink droplets (mist) $M_1$. While the main ink droplet Da flies straightly to reach the printing medium 6, the mist $M_1$ is spread around the flying main ink droplet due to air flow caused by movement of the carriage. The spread mist $M_1$ of the A liquid is deposited even on the surface of the ejection opening of the ink ejecting portion 3 of the B liquid.

As means for cleaning and removing deposition on the ejection surface, a structure for wiping the ejection opening utilizing a blade formed of an elastic material, such as rubber and the like, is typically employed.

However, when the treatment liquid which causes a chemical reaction with the ink on the printing medium to solidify the ink and make it insoluble, is employed for enhancement of printing ability, the chemical reaction can be caused between the ink and the treatment liquid to set on the ejection surface. Setting can be caused by deposition of the mist or rebounded droplets of the treatment liquid in the vicinity of the ejection opening for the image printing ink and by deposition of the mist and rebounding droplets of the ink in the vicinity of the ejection opening of the treatment liquid. A product generated by chemical reaction of the ink and the treatment liquid has quite high viscosity, it is difficult to remove the product by the normal wiping means. If the deposited liquid droplets cannot be removed, deflection of the droplets and ejection failure are possibly caused. In more worse case to cause greater amount of setting on the head, the head becomes entirely impossible to use.

Pollution of the ejection surface by the rebounded droplets may be avoided by provided greater distance between the surface of the printing paper and the ejection surface (hereinafter referred to as "surface distance"). However, if the surface distance becomes greater, a flying distance and flying period of the liquid droplets are inherently increased to cause degradation of precision of droplets hitting position on the surface of the printing paper and thus to cause degradation of the printed image.

The present invention has been worked out in view of the drawbacks in the prior art as set forth above. Therefore, it is an object of the present invention to provide a printing method and a printing apparatus, which can avoid pollution of an ink ejecting portion and a treatment liquid ejecting portion by mist and/or rebounded droplets of an ink or a treatment liquid by reducing ejection amount of the treatment liquid in a smaller-path printing mode in which printing performance and ejection reliability of the printing head are improved.

SUMMARY OF THE INVENTION

The present invention is constructed to variably set an ejection amount of a treatment liquid in one scanning cycle, upon printing of an image on a printing medium by ejecting an ink on a printing medium on which the treatment liquid has been ejected, by detecting a number of scanning cycles for the same region of the printing medium, and varying ejection ratio of the treatment liquid versus dots on the printing medium depending upon the obtained number of scanning cycles.

According to the present invention, it becomes possible to avoid pollution of the ejection surface of the ink ejecting portion of a printing head by rebounding droplets and/or mist of the ink and/or the treatment liquid, by varying the ejection amount of the treatment liquid to reduce under a printing mode of smaller number of scanning cycle for the same region of the printing medium. Thus the present invention permits highly reliable printing.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

The preferred embodiment of the present invention will be discussed hereinafter in detail with reference to the accompanying drawings.

First Embodiment

Figure 1A:
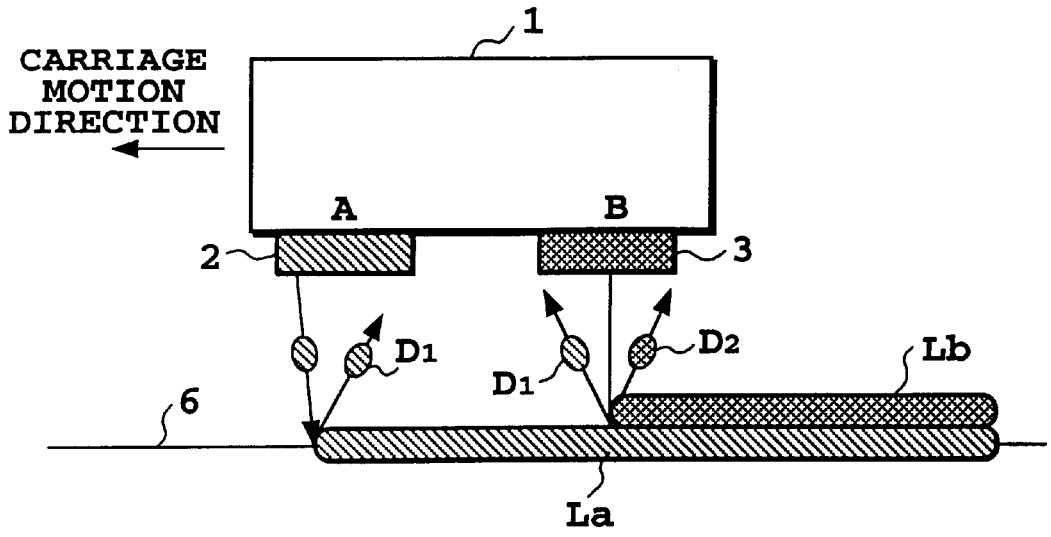
FIG. 1A (PRIOR ART)
FIGS. 1A and 1B are explanatory illustrations showing process of polluting an ejection surface of an ink ejecting portion by rebounding droplets and mist of an ink.
Figure 1B:
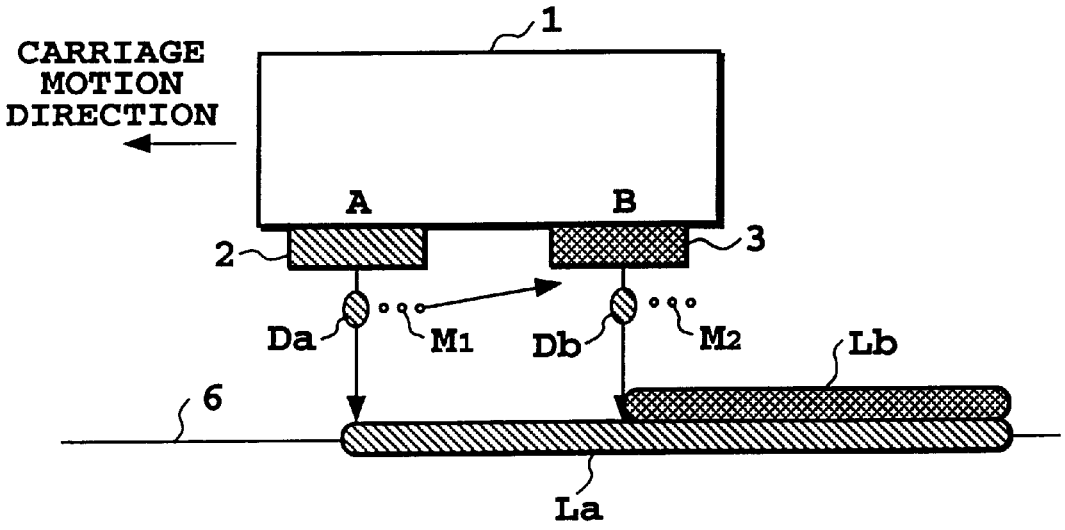
FIG. 1B (PRIOR ART)
Figure 2:
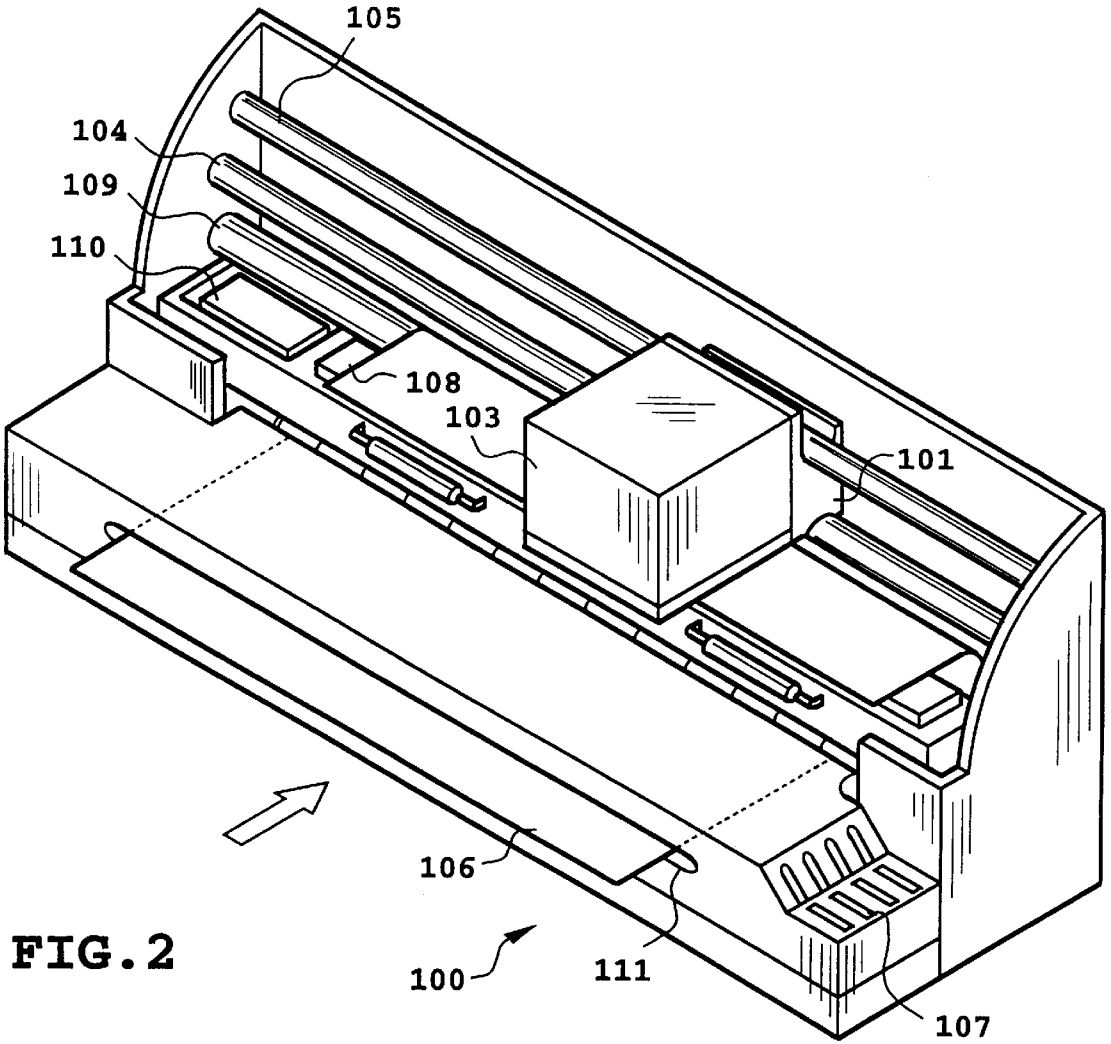
FIG. 2 is a perspective view showing a general construction of one embodiment of an ink-jet printing apparatus, to which the present invention is applied.

FIG. 2 is a perspective view showing a general construction of one embodiment of an ink-jet printing apparatus, to which the present invention is applied.

A printing medium 106 inserted into a paper feeding opening 111 of the ink-jet printing apparatus (hereinafter referred to as printing apparatus) 100, is transported to a printable region of a printing head unit 103 by a transporting roller 109. At a position below the printing medium 106 in the printable region, a platen 108 is provided. A carriage 101 is movable in an axial direction (scanning direction) of two guide bars 104 and 105 for scanning the printing medium 106 by reciprocal motion within the printable region.

The carriage 101 mounts the printing head unit 103 which includes printing heads for ejecting a plurality of colors of coloring inks for image printing (hereinafter simply referred to as ink), a printing head for ejecting a treatment liquid for enhancing printing ability, ink tanks storing inks and the treatment liquid to be supplied to respective printing heads. The printing apparatus 100 of FIG. 2 employs four colors of different inks of black (Bk), cyan (C), magenta (M) and yellow (Y).

At the left end of a region where the carriage 101 is movable, a recovery system unit 110 is provided in the lower portion of the apparatus. The recovery system unit 110 caps a ejecting portion of the printing head while not in printing. The position where the recovery system unit 110 is provided, is referred to a home position of the printing head. On the other hand, at the right end of the printing apparatus 100, an operating portion 107 which has a plurality of switches and display elements, is provided. Each individual switch of the operating portion 107 is used for turning ON and OFF a power supply of the printing apparatus 100 or setting of various printing modes. The display elements are used for displaying the status of the printing apparatus 100.

Figure 3:
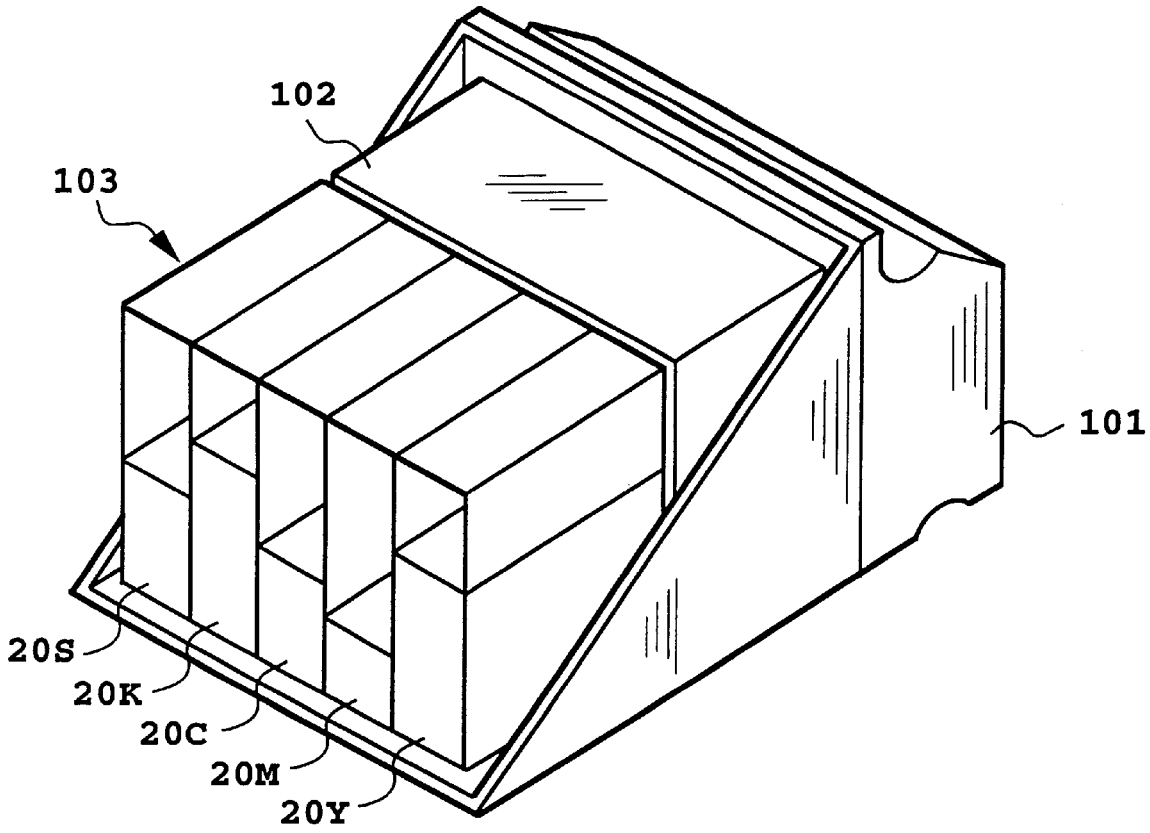
FIG. 3 is a perspective view showing a construction of a printing head unit 103 of the printing apparatus according to the present invention.

FIG. 3 is a perspective view showing a construction of the printing head unit 103.

The printing head unit 103 is one example of a construction, in which respective tanks of respective inks of black, cyan, magenta and yellow and the tank of the treatment liquid are all exchangeable independently of the other.

The carriage 101 mounts printing heads 102 respectively ejecting respective of Bk, C, M and Y inks and the treatment liquid, a Bk ink tank 20K, a C ink tank 20C, M ink tank 20M, a Y ink tank 20Y and a treatment liquid tank 20S. Each tank is connected to a printing head 102 via a coupling portion with the printing head 102. From respective tanks, respective inks and the treatment liquid are supplied to ejection openings.

The construction of the printing head unit is not specified to that illustrated in FIG. 3, but can be a construction, in which the tanks of respective inks and the treatment liquid are integrated, or a construction, in which each tank and the corresponding head are integrated.

Figure 4:
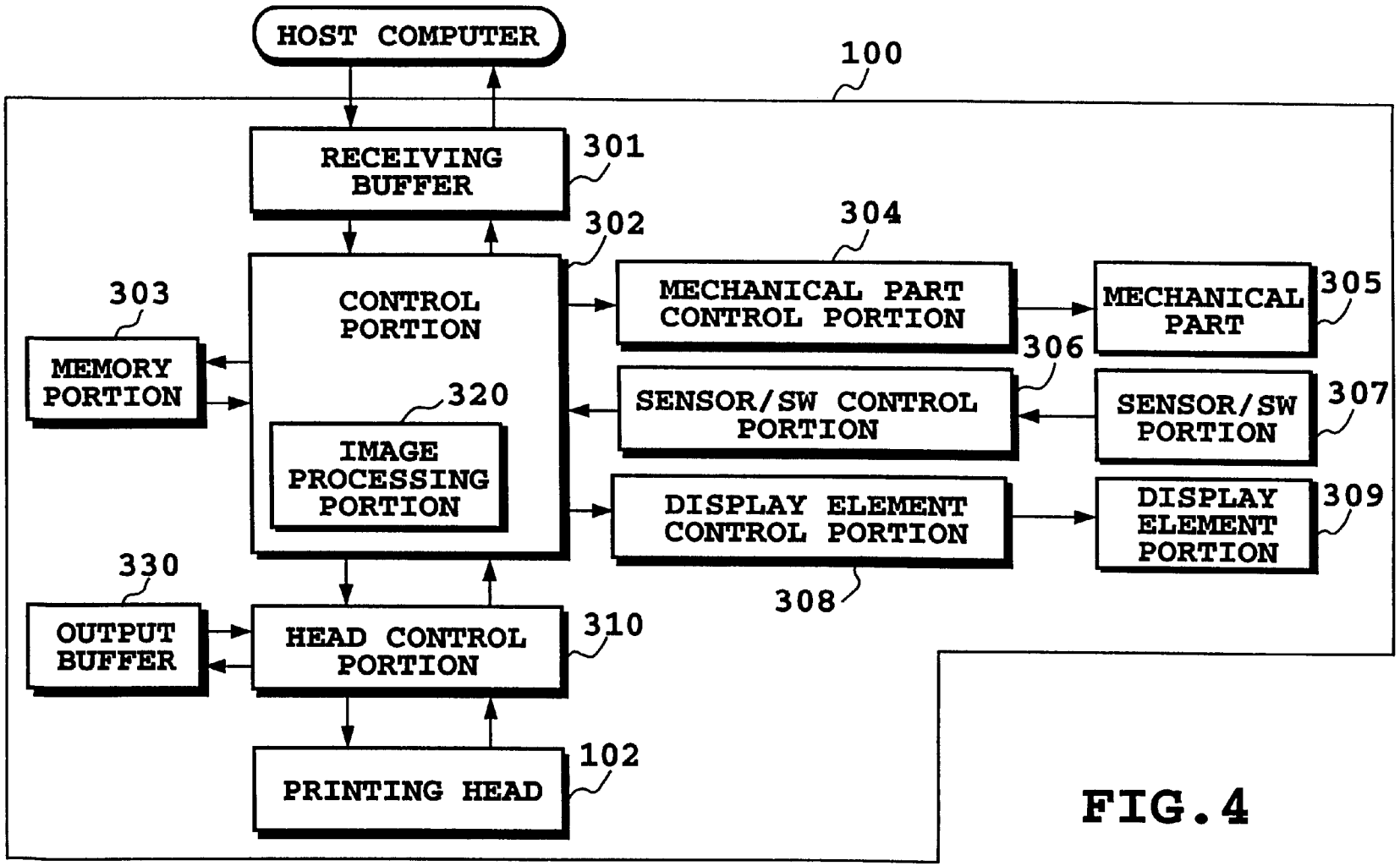
FIG. 4 is a block diagram showing a construction of a control system of the first embodiment of the printing apparatus.
Figure 5:
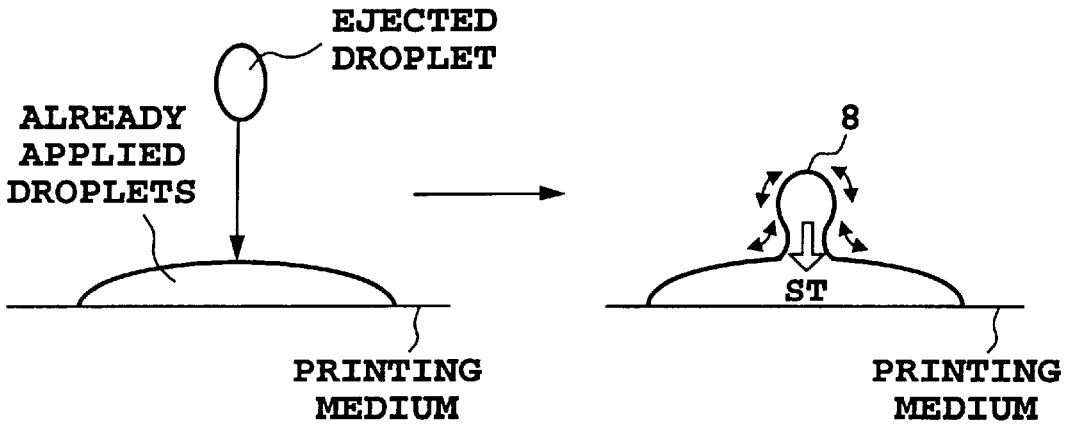
FIG. 5 is an explanatory illustration showing a relationship between a surface tension of a liquid and rebounding.

FIG. 4 is a block diagram showing a construction of a control system of the shown embodiment of the printing apparatus.

A host computer inputs an image data of a character and/or an image to be printed, to a receiving buffer 301 of the printing apparatus 100. The printing apparatus 100 transfers data which confirms that the image data is correctly transmitted, or data which represents operating condition of the printing apparatus 100, to the host computer. The image data input to the receiving buffer 301 is transferred to a memory portion 303 constructed with RAMs and stored temporarily under management of the control portion 302 having an image processing portion 320 and CPU (not shown). A mechanical part control portion 304 controls operation of a mechanical part 305 which is constructed with incorporating a carriage motor or a line feeding motor and the like, serving as driving source for the carriage 101, the transporting roller 109 (see FIG. 2 for both), on the basis of a command from CPU of the control portion 302.

A sensor/SW control portion 306 feeds a signal from a sensor/SW portion 307 which is constructed with incorporating various sensors and switches (SW), to the control portion 302. A display element control portion 308, on the basis of a command from the control portion 302, controls displaying of a display element portion 309 constructed with incorporating LEDs and liquid crystal display elements or the like of display panel group. A head control portion 310 reads out the printing data (ejection data) from an output buffer 330 according to a command from CPU of the control portion 302 and individually controls driving of the respective color heads of inks and the treatment liquid of the printing head 102, on the basis of the printing data. The head control portion 310 also detects information of temperature or the like indicative of conditions of respective heads and transmits the detected information to the control portion 302.

The present invention provides a printing method and a printing apparatus to be implemented in application for the printing apparatus 100 having a construction as set forth above. The invention has been made on the basis of the following phenomenon found by the inventors.

A first phenomenon is a close implication of mist and rebounding droplets with ejection duty. Here, ejection duty represents an ejection ratio for actually ejecting the ink (or the treatment liquid) for deposition versus all dots, or pixels, on the printing medium to deposit the image printing ink (or the treatment liquid). This is a phenomenon, in which when ejection duty of A liquid (e.g. the treatment liquid) and B liquid (e.g. ink) is reduced upon performing printing by two kinds of liquids, pollution on the ejection surface of the ink ejecting portion is reduced associating with reduction of the ejection duty. This phenomenon is caused for reduction of the mist according to reduction of the ejection amount in one ejection, for reduction of rebounding for not sequentially spreading the A liquid in a wide range by reduction of the ejection duty of the A liquid, and for reduction of the rebounded droplets of the A liquid itself and the treatment liquid itself by reducing the number of ejected droplets of the A liquid and the B liquid.

A second phenomenon is that occurrence of rebounded liquid droplets depends on a magnitude of surface tension of the liquid. The rebounded liquid is caused by partial separation of the A liquid and/or the B liquid on the printing medium due to ejection of the B liquid after ejection of the A liquid. When the surface tension of the liquid on the printing medium is large, a force ST of the surface tension acts on the liquid so as to keep integrity of the rebounding portion 8. Accordingly, when the surface tension is large, the separation will never be caused and thus rebounded droplets are not generated. Conversely, in the case of a liquid of small surface tension, the force ST is small to easily cause the separation of the rebounded portion 8 to generate the rebounded droplets.

Next, the method according to the present invention will be explained specifically.

Figure 6:
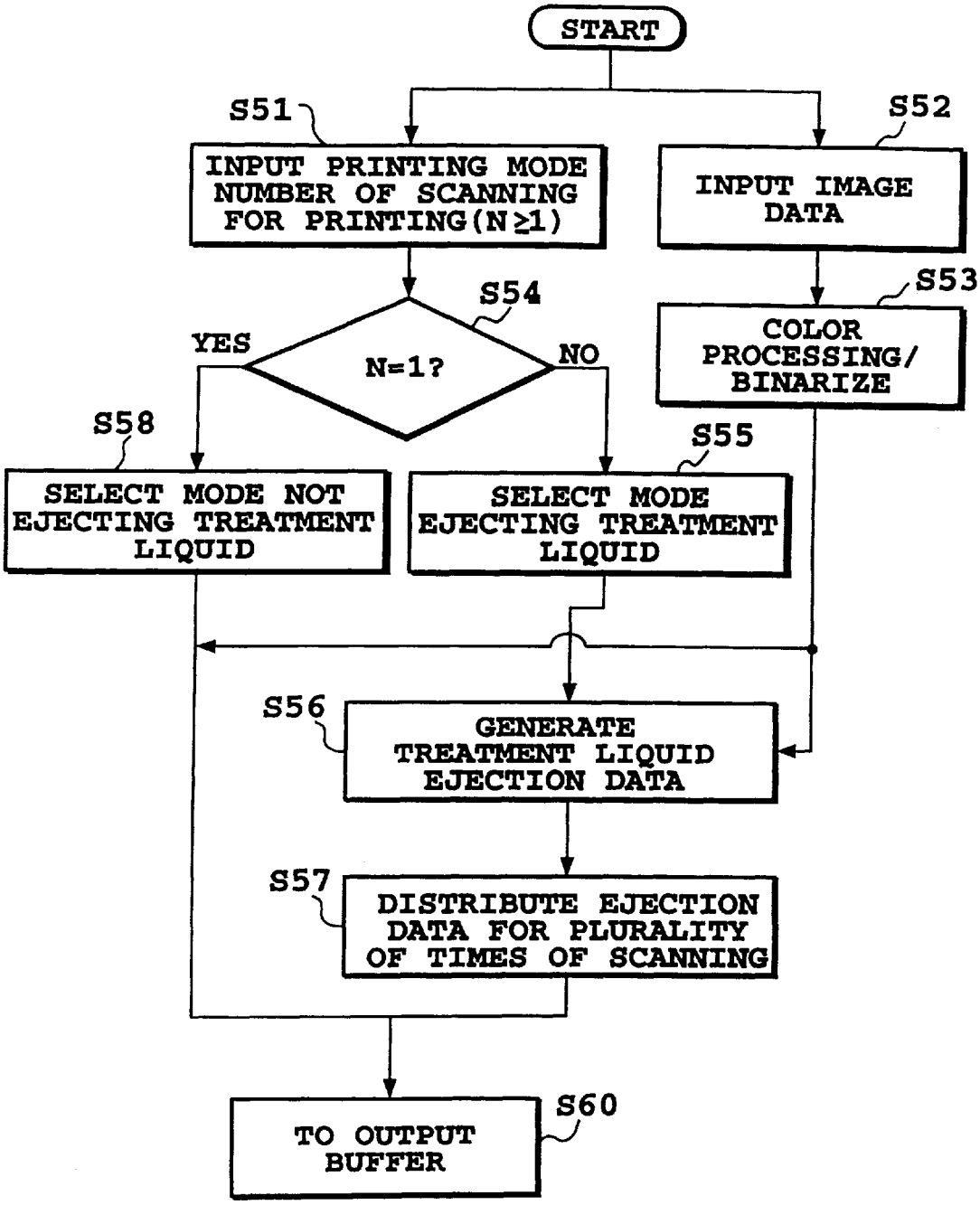
FIG. 6 is a flowchart showing flow of printing operation in the first embodiment.

FIG. 6 is a flowchart showing flow of printing operation.

At first, at step S51, one of printing modes for printing output is selected and input. A number N of scanning for printing ($N \geqq 1$) to the same scanning region is selected depending upon the printing mode. At step S52, an image data of the image to be printed is read out. The image data is processed by color correction and the like and thereafter separated into respective color data of C, M, Y and Bk which are to be converted into binary data (step S53).

At step S54, a value of number N of the scanning is checked depending upon the printing mode to make selection of one of a mode for ejecting the treatment liquid and a mode for not ejection the treatment liquid. When the printing mode is a multi-path printing mode to perform printing by two or more times of scanning ($N \neq 1$), the "printing mode ejecting the treatment liquid" is selected (step S55). On the other hand, when N=1 and thus the selected and input printing mode is a single-path printing mode, the "printing mode not ejecting the treatment liquid" is selected (step S58).

In case of the single-path printing mode, the image to be formed by all image data for the same scanning region has to be printed by one scanning. Therefore, the ejection duty of the ink tends to be high. If the ejection duty of the ink and the ejection duty of the treatment liquid are increased in comparable ratio, a large amount of mist and rebounded droplets of the ink should be generated as described above, resulting in lowering of reliability of ejection. In the shown embodiment, in order to improve reliability of ejection, the process is advanced to step S58 at the single-path printing mode depending upon the judgment result of step S54, to process the image data so as not to eject the treatment liquid.

When a multi-path printing mode is selected and the process is advanced to step S55, the ejection data for ejection of the treatment liquid corresponding to the printing mode, is generated at step S56, on the basis of the image data binarized at step S53. Then, the ink ejection data for printing by the inks and the ejection data for the treatment liquid are assigned for each scan corresponding to the printing mode (step S57). Respective assigned ejection data is fed to an output buffer 330 for driving the printing head 102 (step 60).

In case of the multi-path printing mode, since the image corresponding to the printing data of the same scanning region is completed by plural times of scanning, the ejection duty in one scanning, or ink ejection amount, is reduced. Accordingly, the mist and the rebounding droplet becomes smaller so as not to significantly cause pollution of the ejection surface of the printing head even when the treatment liquid is ejected.

On the other hand, when the single-path printing mode is selected, the process is advanced to step S58. Then, the data for C, M, Y and Bk binarized at step S53 are fed to the output buffer 330 for driving the printing head 102 (step S60). The head control portion 310 controls driving of the printing head 102 for performing printing on the basis of the data stored in the output buffer 330.

FIGS. 7A to 7E are explanatory illustration showing one example of the ejection data for the ink and the treatment liquid in the shown embodiment.

Figure 7A:
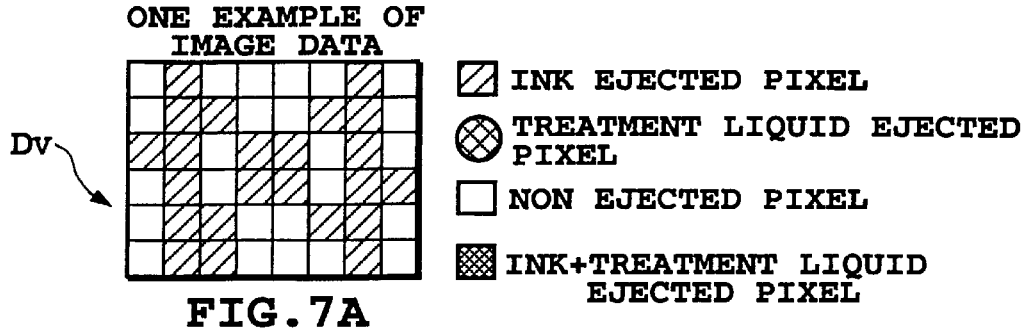
FIGS. 7A to 7E are explanatory illustrations showing examples of printing of the ink and the treatment liquid in the first embodiment.

FIG. 7A represents the image data Dv, i.e., binary data of the image data for a single color image to be printed by the ink on the printing medium. The image data Dv represents an image of six pixels in vertical direction and eight pixels in horizontal direction.

When the single color image printing depending upon the image data Dv of FIG. 7A is performed by the single-path printing mode, the process at step S58 is performed as shown in the flowchart of FIG. 6 so that the treatment liquid is not ejected.

Figure 7B:
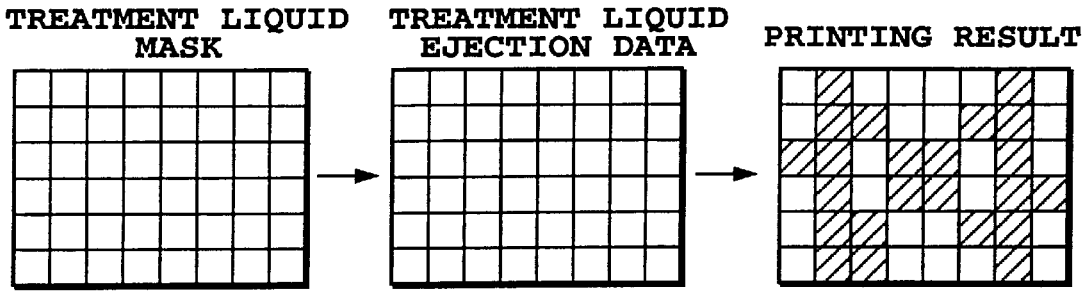

The printing data for printing by the ink, obtained through the process at step S58 (hereinafter referred to as ink ejection data) is similar to the image data Dv of FIG. 7A. A treatment liquid mask for ejecting the treatment liquid is set for not ejecting the treatment liquid for all pixels, as shown in FIG. 7B. Accordingly, as shown in FIG. 7B, the ejection data for the treatment liquid becomes indicative of not ejecting for all pixels. The printing result of the image on the printing medium is constituted of the pixels obtained by ejection of only ink.

Figure 7C:
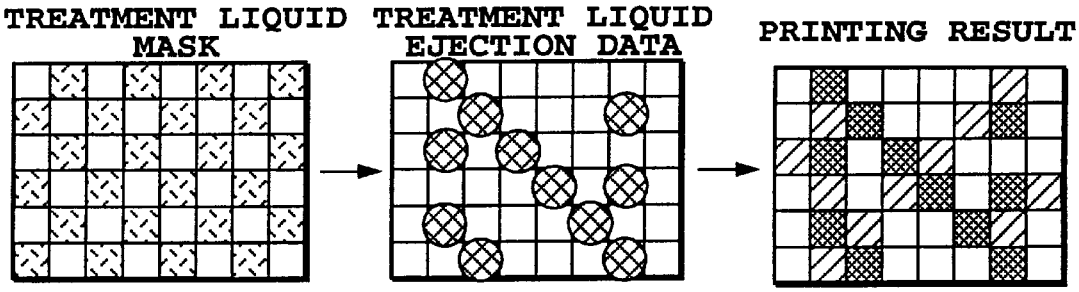

When printing is performed in the multi-path printing mode, the ejection data of the treatment liquid is generated on the basis of the ink ejection data by a predetermined method. FIG. 7C shows one example of ejection of the treatment liquid at 50% of ejection duty in a discrete manner, with respect to the image data Dv of six pixels in vertical direction and eight pixels in horizontal direction. The ejection data of the treatment liquid is thinned by a treatment liquid mask of checkered pattern, as shown in FIG. 7C, to extract one half data of the pixel to be printed by the ink. The ejection data of the treatment liquid thinned by the treatment liquid mask of the checkered pattern is shown in FIG. 7C, and the treatment liquid for 50% of pixels of the image data Dv is ejected. As a result of ejecting the ink for overlaying on the pixel, on which the treatment liquid has been ejected, the printing result of the image on the printing medium is consisted of the pixels, as shown in FIG. 7C, on which only ink is ejected, and the pixels on which both of the ink and the treatment liquid are ejected.

The ejection duty of the treatment liquid mask for generating the treatment liquid ejection data is not limited to the example shown in FIG. 7C, and the ejection duty can be increased or decreased depending upon characteristics of the ink and the treatment liquid to be used.

Figure 7D:
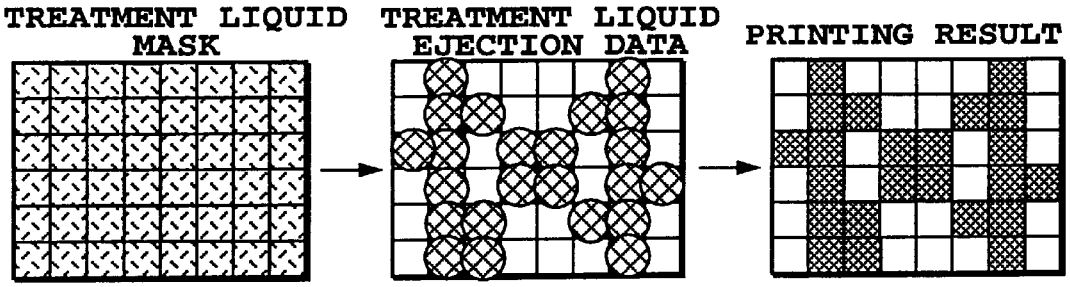

FIG. 7D shows an example, in which the ejection duty of the treatment liquid is increased to be greater than that of FIG. 7C. Generating the ejection data by the treatment liquid mask as shown in FIG. 7D makes the ejection duty of the treatment liquid to be 100%. Namely, all of the pixels to be printed by the ink are extracted, and the treatment liquid is ejected for the extracted pixels. Accordingly, the ejection data of the treatment liquid is the same as the data of the image to be printed by the ink, as shown in FIG. 7D. As a result of ejecting the ink for overlaying on the pixels, on which the treatment liquid has been ejected, the printing result of the image on the printing medium is consisted of the pixels obtained by ejections of the ink and the treatment liquid, as shown in FIG. 7D.

Figure 7E:
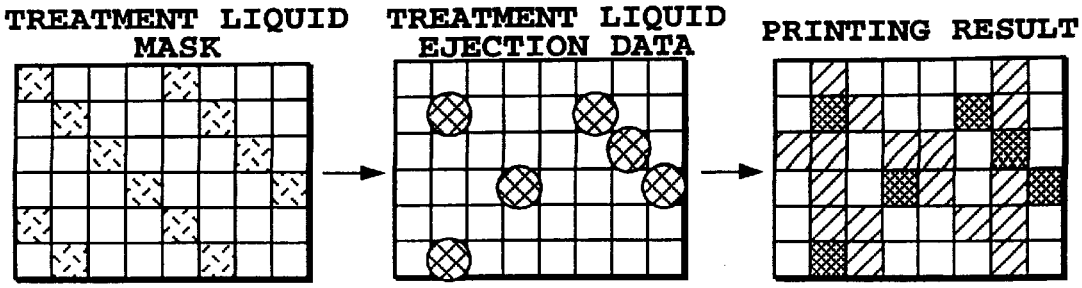

FIG. 7E shows an example where the ejection duty of the treatment liquid is set to be smaller than that of FIG. 7C. Thinning the ejection data by the treatment liquid mask as shown in FIG. 7E makes the ejection duty of the treatment liquid to be 25%. Namely, one fourth of the pixels to be printed by the ink are extracted, and the treatment liquid is ejected for the extracted pixels. Accordingly, the ejection data of the treatment liquid is shown in FIG. 7E. As a result of ejecting the ink for overlaying on the pixels, on which the treatment liquid has been ejected, the printing result of the image on the printing medium, as shown in FIG. 7E, is consisted of the pixels obtained by ejection of only the ink and the pixels obtained by ejections of both the ink and the treatment liquid.

The arrangement of the pixels, in which the treatment liquid data is thinned, is not limited to the shown example, and can be ones at random and the arrangement thinned depending upon presence or absence of the image data. A method of thinning may be varied depending upon characteristics of the ink and/or the printing medium.

The ink and the treatment liquid used in the embodiment have the following properties. The ink contains an anion type dye, and the treatment liquid contains a cation type material consisted of low molecular components and a polymeric component.

One example of particular composition of the ink and the treatment liquid for enhancing the printing ability will be shown hereinafter.

| | |
|---|---|
| (Y Ink) | |
| glycerine | 5.0 Wt % |
| thiodiglycol | 5.0 Wt % |
| urea | 5.0 Wt % |
| isopropyl alcohol | 4.0 Wt % |
| dye C. I. direct yellow 142 | 2.0 Wt % |
| water | remainder |
| (M Ink) | |
| glycerine | 5.0 Wt % |
| thiodiglycol | 5.0 Wt % |
| urea | 5.0 Wt % |
| isopropyl alcohol | 4.0 Wt % |
| dye C. I. acid red 289 | 2.5 Wt % |
| water | remainder |
| (C Ink) | |
| glycerine | 5.0 Wt % |
| thiodiglycol | 5.0 Wt % |
| urea | 5.0 Wt % |
| isopropyl alcohol | 4.0 Wt % |
| dye C. I. direct blue 199 | 2.5 Wt % |
| water | remainder |
| (Bk Ink) | |
| glycerine | 5.0 Wt % |
| thiodiglycol | 5.0 Wt % |
| urea | 5.0 Wt % |

-continued

| | |
|---|---|
| isopropyl alcohol | 4.0 Wt % |
| dye food black 2 | 3.0 Wt % |
| water | remainder |
| (Treatment Liquid) | |
| polyallyl amine hydrochloride | 5.0 Wt % |
| alkydimethylbenzylammonium chloride | 1.0 Wt % |
| diethylene glycol | 10.0 Wt % |
| acetinol EH (Kawaken Chemical) | 0.5 Wt % |
| water | remainder |

Here, the example employing dyes as coloring agents of respective color inks of Y, M, C and Bk has been disclosed. However, the coloring agents to be used is not specified to the shown examples. For instance, the inks using pigments as the coloring agents, or the inks using a mixture of dyes and pigments as the coloring agents, may also be employed. In such cases, by using the optimal treatment liquid which may coagulate respective inks containing the coloring agents, comparable effect may be obtained.

Second Embodiment

The former first embodiment is the example not ejecting the treatment liquid upon the single-path printing mode, and ejecting the treatment liquid upon the multi-path printing mode, in which printing is performed by scanning twice or more.

Moreover, when pollution of the ejection surface by the mist and/or the rebounded droplets is serious due to combination of the ink and the treatment liquid, or when a frequency of cleaning operation for maintaining ejection reliability is desired to be reduced, it becomes necessary to further reduce the mist and/or the rebounded droplets. In order to satisfy this, the shown embodiment is designed so as not to eject the treatment liquid even in the multi-path printing mode, if a number of scan is less than or equal to a predetermined value.

Figure 8:
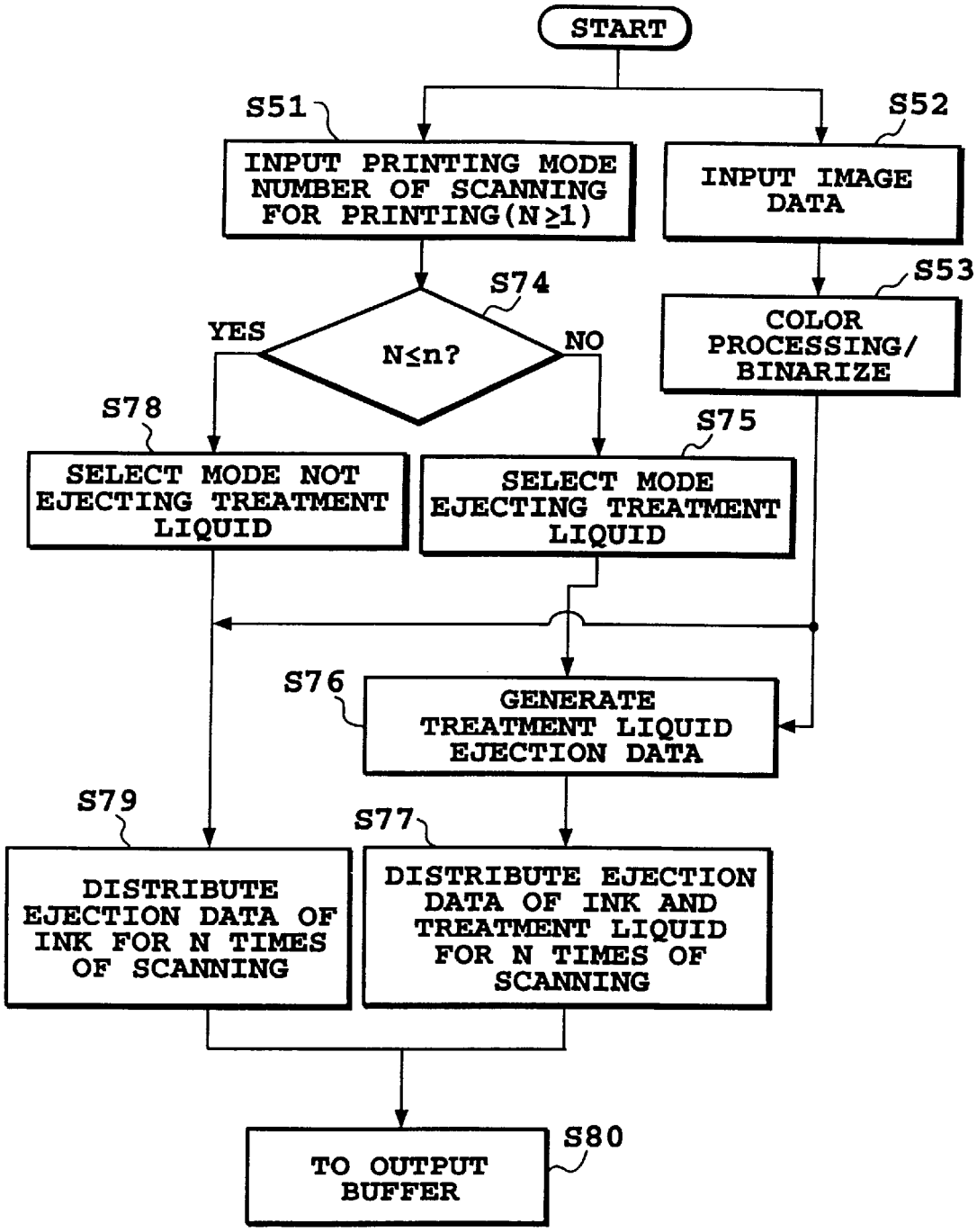
FIG. 8 is a flowchart showing flow of printing operation in the first embodiment.

FIG. 8 is a flowchart showing a sequence of the printing operation in the shown embodiment.

Since the sequence of FIG. 8 is similar to those of the first embodiment, the same step numbers are given for the corresponding steps and descriptions for such common steps are neglected for avoiding redundant description to keep the disclosure simple enough to facilitate clear understanding of the invention. Also, since processes at steps S75, S76 and S78 are respectively the same as those at steps S55, S56 and S58, explanations for these steps will also be neglected.

Briefly explaining the process shown in FIG. 8, a parameter at the step S47 for making judgment whether the treatment liquid is to be ejected or not is different from that in the first embodiment. Namely, in the first embodiment, the judgment is made depending upon whether the number N of scan is greater than one or not, whereas, in the shown embodiment, the judgment is made depending upon whether the number N of scan is greater than a predetermined number n of scan (n is an arbitrarily integer of $n \geqq 2$). If the number N of scan in the selected printing mode is less than or equal to n, a mode not ejecting the treatment liquid is selected, and otherwise another mode ejecting the treatment liquid is selected. As set forth, in this case, n is integer greater than or equal to two and may be preliminarily set depending upon kinds of the ink and the treatment liquid or other relevant factors.

At step S74, if not $N \leqq n$ and thus the printing mode ejecting the treatment liquid is selected (step S75), the ejection data of the treatment liquid is generated with a preset ejection duty depending upon the kinds of the ink and the printing medium (step S76). At step S77 following step S76, the ink ejection data and the ejection data of the treatment liquid for printing by the ink are distributed for N times of scanning for printing.

On the other hand, if $N \leqq n$ at step S74, the printing mode not ejecting the treatment liquid is selected (step S78). Then, subsequently at step 79, the ink ejection data for printing by the ink is distributed for N times of scanning for printing. Each of the distributed data is fed to the output buffer 330 (step S80).

In the shown embodiment, by not ejecting the treatment liquid when N is less than or equal to the predetermined number n of scan, pollution of the ejection surface by the mist and/or the rebounded droplets can be further reduced to improve reliability of ejection.

Third Embodiment

In the first and second embodiments, examples, in which the judgment of ejecting the treatment liquid or not are made depending upon the number of scan. In the shown embodiment, an example, in which thinning ratio of the ejection data for the treatment liquid is varied, depending upon the number of scan, to increase ejection duty of the treatment liquid according to increasing of the number of scan, will be explained. In the shown embodiment, in order to avoid pollution of the ejection surface of the printing head and to maintain reliability of ejection, a maximum ejection duty of the treatment liquid, with which an allowable maximum amount of the treatment liquid is ejected at one scan, is set. The shown embodiment is effective for the case where pollution of the ink ejection surface or the treatment liquid ejection surface is small for the reason of use of the ink having high surface tension, quickness in absorption and fixing of the ink, and use of the printing medium difficult to rebound the ink, and so on. In the shown embodiment, since the treatment liquid is ejected in all of the printing modes, enhancement of the printing ability, such as addition of water-resistance and the like, can be realized in addition to improvement of ejection reliability, in all of the printing modes.

Figure 9A:
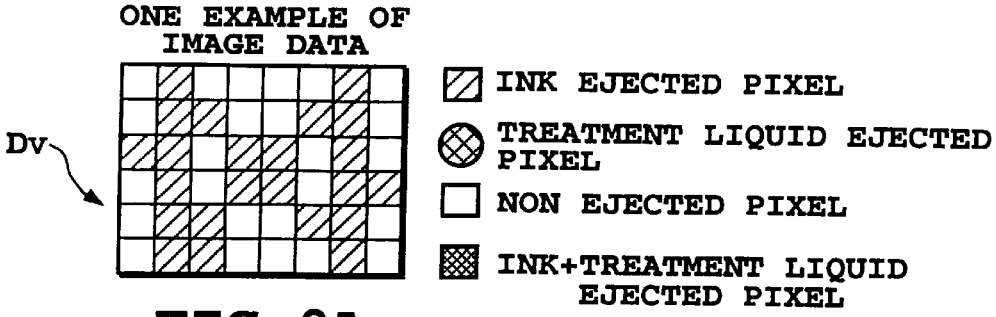
FIGS. 9A to 9D are explanatory illustrations showing examples of printing of the ink and the treatment liquid in the first embodiment.

FIGS. 9A to 9D are explanatory illustration showing one example of ejection of the shown embodiment of the ink and the treatment liquid. FIG. 9A is the same as FIG. 7A, and explanation therefor is neglected.

One example of printing depending upon the image data Dv shown in FIG. 7A will be explained hereinafter. In this example, ejection of the treatment liquid is performed with setting the maximum ejection duty of the treatment liquid capable of ejection in one scan at 25%. The maximum ejection duty of the treatment liquid, which is permitted in the ejection of the treatment liquid in one scan, is determined optimally within a range so as not to degradate ejection reliability on the basis of properties of the inks and the treatment liquid.

Figure 9B:
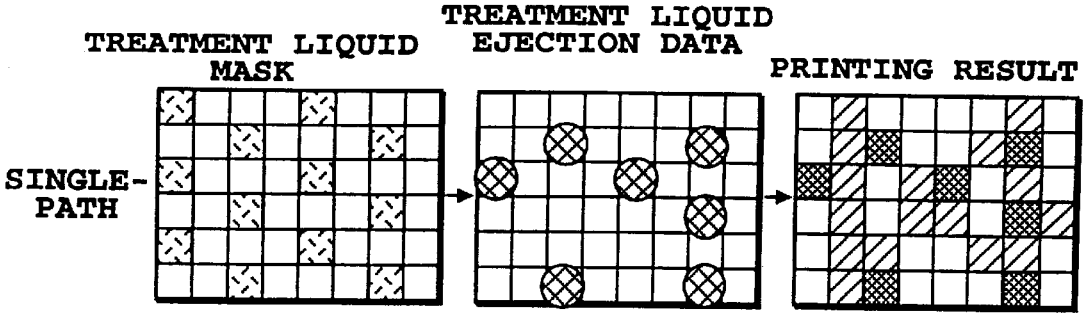
Figure 9C:
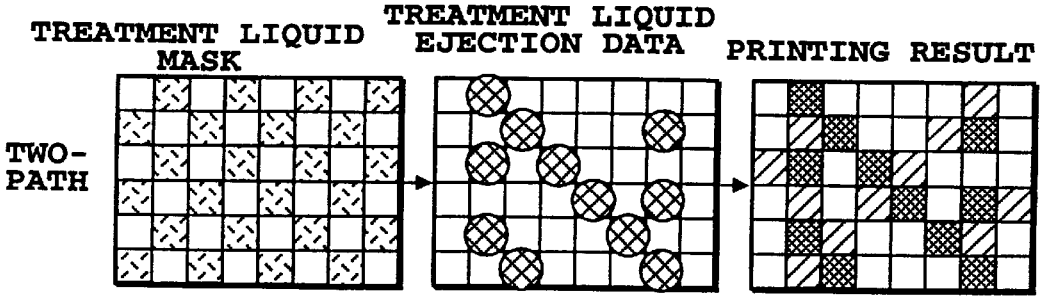

FIG. 9B shows the ejection pattern of the treatment liquid and an image of printing result upon selection of a single-path printing mode. In the single-path printing mode, since the image in the same scanning region is all formed at single scan, the ejection duty of the treatment liquid to be ejected is 25% which is the maximum ejection duty for one scan. Accordingly, when the single-path printing mode is selected, as shown in FIG. 9B, the ejection data is extracted from the image data Dv utilizing the treatment liquid mask for thinning data of 25% of pixels, and thus the ejection data for the treatment liquid is generated. As a result of ejecting the treatment liquid on the pixels, on which the ink is ejected according to the image data Dv, the resulting image on the printing medium is consisted of the pixels formed by ejection of only the ink, and the pixels formed by ejections of both of the ink and the treatment liquid, as shown in FIG. 9C.

Upon selection of a two-path printing mode, the image in the same scanning region is formed dividingly by two scans. Accordingly, by ejecting the treatment liquid at the ejection duty of 25% at one scan, respectively, the ejection duty of the treatment liquid as total of two scans can be increased to 50%. One example of ejection of the treatment liquid upon selection of the two-path printing mode is shown in FIG. 9C. When the two-path printing mode is selected, the data is extracted from the image data Dv using the treatment liquid mask for thinning data of 50% of pixels, as shown in FIG. 9C, to generate the ejection data for the treatment liquid. As a result of ejecting the treatment liquid on the pixels, on which the ink is ejected according to the image data Dv, the resulting image on the printing medium is consisted of the pixels formed by ejection of only the ink, and the pixels formed by ejections of both of the ink and the treatment liquid, as shown in FIG. 9C.

Figure 9D:
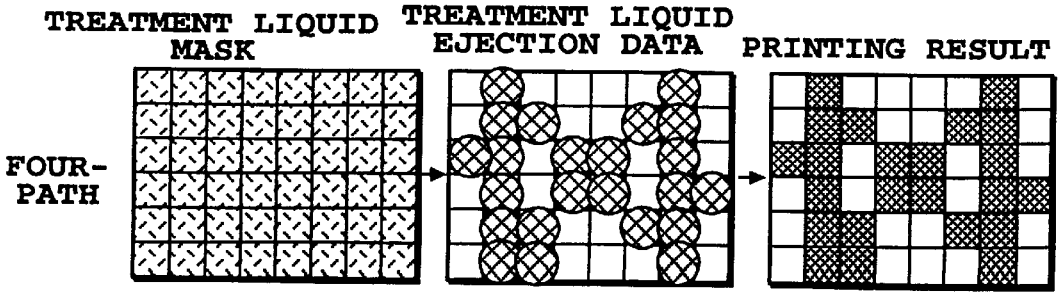

Upon selection of a four-path printing mode, the image in the same scanning region is completely formed dividingly by four scans. Thus, the ejection duty of the treatment liquid as total of four scans can be increased to 100% of four times of 25%. Accordingly, the ejection data of the treatment liquid becomes the same as the ejection data of the ink, as shown in FIG. 9D. Namely, when the four-path printing mode is selected, the data is extracted from the image data Dv using the treatment liquid mask for not thinning data of pixels, as shown in FIG. 9D, to generate the ejection data for the treatment liquid. As a result of ejecting the treatment liquid on the pixels, on which the ink is ejected according to the image data Dv, the resulting image on the printing medium is consisted of the pixels formed by ejections of both of the ink and the treatment liquid, as shown in FIG. 9D.

Figure 10A:
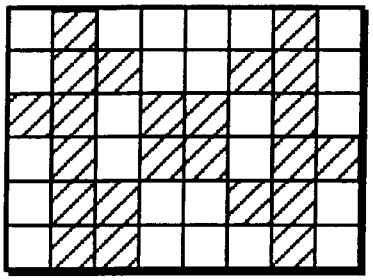
FIGS. 10A to 10E are explanatory illustrations showing example of printing method by the ink in each scan in printing of twice scanning, in the third embodiment.

FIGS. 10A to 10E are explanatory illustrations showing an example of printing by the ink in each scan upon two-path printing, and FIGS. 11A to 11E are explanatory illustrations showing example of ejection of the treatment liquid in each scan of two-path printing. In FIG. 10A, the ejection data depends on the image data Dv shown in FIG. 9A. Similarly, in FIG. 11A, the ejection data of the treatment liquid depends upon that of the treatment liquid shown in FIG. 9C.

Upon distribution of data for twice of scanning, the mask of fixed pattern is generally used. In the shown embodiment, the pattern of the mask to be used is set to avoid a synchronization with the ejection pattern (thinning pattern) of the treatment liquid and a matching of both of the patterns. The reason for avoiding the pattern matching is to prevent the following problem. The problem is that, in case of the distribution mask setting to the checkered pattern, for multi-path printing, when the thinning pattern of the treatment liquid is checkered one as shown in FIG. 9C, the treatment liquid is ejected for all data of the treatment liquid at a first scan, and no liquid ejection at a second scan at all. When both of the patterns are matched, while the maximum ejection duty of the treatment liquid permitted for one scan is 25%, the ejection duty at the first scan becomes 50% to increase pollution of the ink ejection surface by mist and/or rebounded droplets to cause degradation of ejection reliability.

Figure 10B:
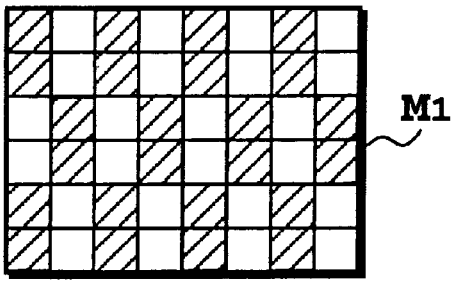
Figure 10C:
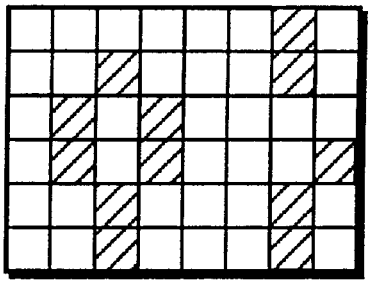
Figure 10D:
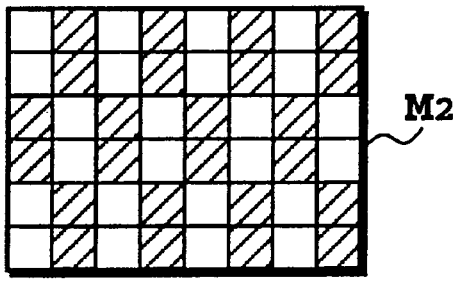
Figure 10E:
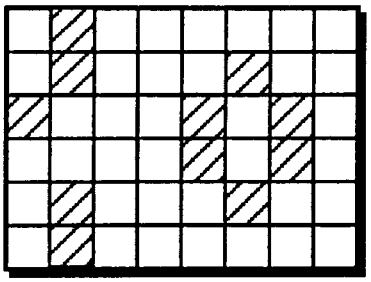
Figure 11A:
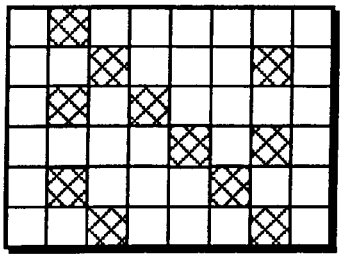
FIGS. 11A to 11E are explanatory illustrations showing example of printing method by the treatment liquid in each scan in printing of twice scanning, in the third embodiment.
Figure 11B:
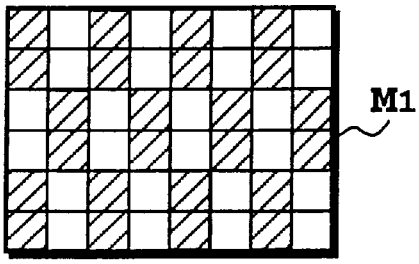
Figure 11C:
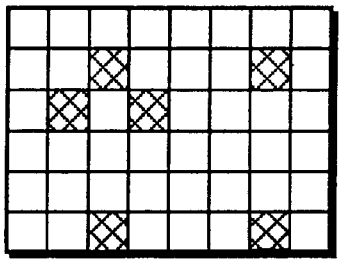
Figure 11D:
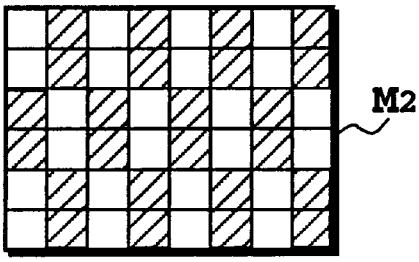
Figure 11E:
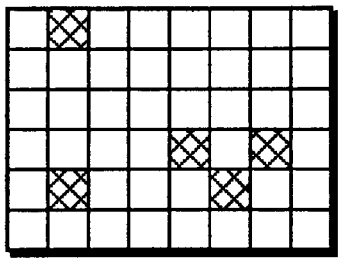

Therefore, in order to avoid the foregoing problem, it is necessary to distribute the ejection data using, for example, a two-path distributing mask $M_1$ and $M_2$, as shown in FIG. 10B and 10D, which masks two pixels continuing in vertical, and perform printing by ejecting the ink according to the distributed data. Then, using similar two-path distributing masks $M_1$ and $M_2$ shown in FIGS. 11B and 11D, the ejection data is distributed for two scans of the first scan and the second scan for ejecting the treatment liquid by the distributed data. FIGS. 10C and 11C show ejection data of the ink and the ejection data of the treatment liquid in the first scan. FIGS. 10E and 11E show ejection data of the ink and the ejection data of the treatment liquid in the second scan.

As can be clear from FIGS. 11C and 11E, the ejection data of the treatment liquid satisfies constraint of 25% of the maximum ejection duty per one scan in both of the first and second scans.

Accordingly, occurrence of the problem of no ejection can be avoided, increasing of pollution of the ink ejection surface by the mist and/or the rebounding droplets and degradation of reliability of ejection will not be encountered.

A method of generation of the ejection data of the treatment liquid is not specified to the foregoing example, and the distribution mask for multi-path printing is also not limited to the foregoing example. It is possible to distribute the ejection data in a random manner. However, in this case, distributing data of all treatment liquid at one scan has to be avoided in the reason set forth above.

Furthermore, the embodiment represents an example in which the ejection ratio of the number of scan to the treatment liquid is proportional, it is not necessary to select certain ejection ratio proportional to the number of scanning. It is required to increase a final ejection duty of the treatment liquid in total according to increasing in the number of scan. Thus, the ejection duty in total may be selected to 25% in single-path (scan) printing, 40% in two-path (scan) printing and 50% in four-path (scan) printing.

Fourth Embodiment

In the third embodiment, an example determinating the duty of the ejection data of the treatment liquid only by the number of scans in the case where the ink ejection duty finally becomes 100%, is shown.

On the other hand, when an image having higher density is desired to be obtained, printing is performed in an enhancing printing mode depending upon a kind of the printing medium. In the enhancing printing mode, the ink droplets are ejected for a plurality of times in an overlapping manner to a certain rate of the pixels among all pixels of the image. In this case, the ejection duty of the treatment liquid to be ejected in one scan is held unchanged. Therefore, in case of the enhancing printing mode, in which ejection is performed in overlapping manner, the ejection duty of the treatment liquid is determined depending upon a number of scan, and a number of time of overlapping ejection.

As one example of determination of the ejection duty, a printing method of the ink and the treatment liquid in a case where two time ejection in overlapping manner is performed for all of the pixels to be printed in two scans (ink ejection duty is 200%), will be explained with reference to FIGS. 12A to 12E. In this case, the images in the same scanning region are all formed by two scans. Since the printing of the same printing data is performed twice, the ejection duty in each scan becomes the same as that in the single-path printing mode. It should be noted that the maximum ejection duty of the treatment liquid to be ejected in one scan is 25%, similarly to the third embodiment.

Figure 12A:
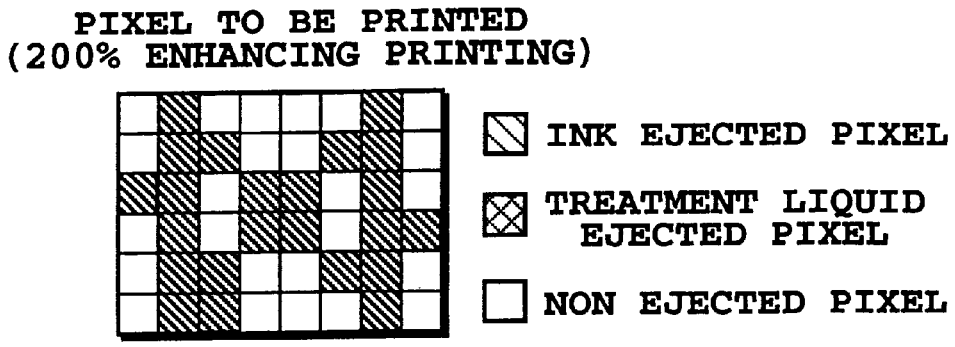
FIGS. 12A to 12E are explanatory illustrations showing example of printing method by the ink and the treatment liquid in each scan in printing of twice scanning, in the fourth embodiment.
Figure 12B:
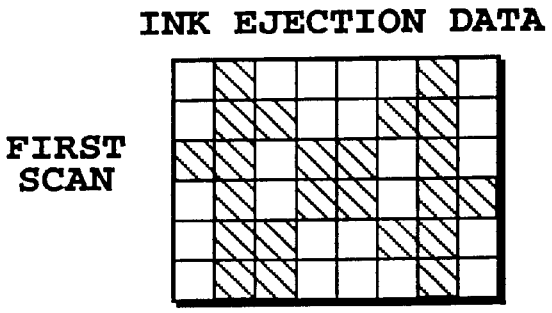
Figure 12C:
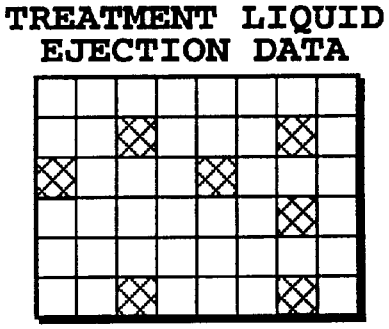
Figure 12D:
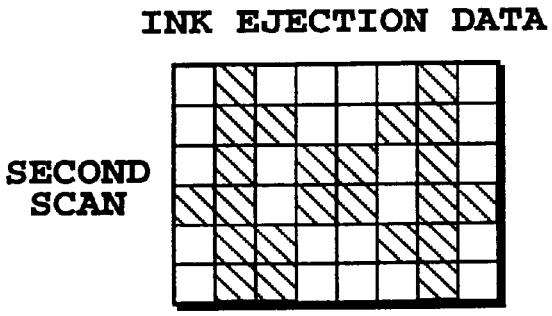
Figure 12E:
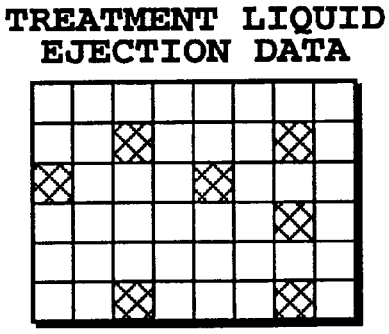

In the first scan, the ejection data of the ink is not thinned and thus becomes the same as an image data Dvv shown in FIG. 12A, as shown in FIG. 12B. In contrast to this, the ejection data of the treatment liquid is thinned so that 25% of ejection duty is established as shown in FIG. 12C, by the predetermined method. On the other hand, in the second scan, the ejection data of the ink and the ejection data of the treatment liquid same as those of the first scan are used. Therefore, the ejection data of the ink is not thinned and thus becomes the same as the image data Dvv shown in FIG. 12A, as shown in FIG. 12D. The ejection data of the treatment liquid is thinned so that 25% of ejection duty is established as shown in FIG. 12E, similar to FIG. 12C.

Thus, the ejection data is generated by determining the ejection duty of the treatment liquid depending upon the number of scan and the number of times of ejection, and then, first and second scans are performed on the basis of the ejection data. Thus, the enhancing printing mode of ejection duty of 200% can be realized, for example. Therefore, the high density printing image can be formed for any printing medium.

The present invention achieves distinct effect when applied to a printing head or a printing apparatus which has means for generating thermal energy such as electrothermal transducers or laser light, and which causes changes in ink by the thermal energy so as to eject ink. This is because such a system can achieve a high density and high resolution printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to printing information; second, the thermal energy induces sudden temperature rise that exceeds the nucleate boiling so as to cause the film boiling on heating portions of the printing head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a printing head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the printing head, the present invention can achieve printing positively and effectively.

In addition, the present invention can be applied to various serial type printing heads: a printing head fixed to the main assembly of a printing apparatus; a conveniently replaceable chip type printing head which, when loaded on the main assembly of a printing apparatus, is electrically connected to the main assembly, and is supplied with ink therefrom; and a cartridge type printing head integrally including an ink reservoir.

It is further preferable to add a recovery system, or a preliminary auxiliary system for a printing head as a constituent of the printing apparatus because they serve to make the effect of the present invention more reliable. Examples of the recovery system are a capping means and a cleaning means for the printing head, and a pressure or suction means for the printing head. Examples of the preliminary auxiliary system are a preliminary heating means utilizing electrothermal transducers or a combination of other heater elements and the electrothermal transducers, and a means for carrying out preliminary ejection of ink independently of the ejection for printing. These systems are effective for reliable printing.

The number and type of printing heads to be mounted on a printing apparatus can be also changed. For example, only one printing head corresponding to a single color ink, or a plurality of printing heads corresponding to a plurality of inks different in color or concentration can be used. In other words, the present invention can be effectively applied to an apparatus having at least one of the monochromatic, multicolor and full-color modes. Here, the monochromatic mode performs printing by using only one major color such as black. The multi-color mode carries out printing by using different color inks, and the full-color mode performs printing by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet printing apparatus of the present invention can be employed not only as an image output terminal of an information processing device such as a computer, but also as an output device of a copying machine including a reader, and as an output device of a facsimile apparatus having a transmission and receiving function.

According to the present invention, by reducing the ejection amount of the treatment liquid in the printing mode, in which the number of scanning for the same region of the printing medium is small, pollution of the ejection surface of the ink of the printing head by the rebounded droplets and mist can be avoided, and a printing with high reliability can be performed effectively. Furthermore, in the present invention, the user is required for only selection of the printing mode to easily obtain the foregoing effect without performing complicate operation upon printing.

The method of the present invention is applicable for a system constructed with a plurality of devices, or for an apparatus constituted of one device. On the other hand, needless to say, the method according to the present invention is applicable for a case where the method is achieved by supplying a program for the system or the apparatus. In this case, by loading the program expressed by the software for achieving the method of the present invention to the system or the apparatus from a storage medium, the system and apparatus may obtain the effect of the method of the present invention.

The present invention has been described in detail with respect to preferred embodiments, and it will now be apparent form the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing method, scanning a printing medium for ejecting first and second liquids on said printing medium for printing an image of said second liquid on said printing medium, said printing method comprising:

a judgment step of judging a number of scans for a same region of said printing medium; and an ejection amount varying step of variably setting an ejection amount of said first liquid in one scan in the region depending upon said number of scans obtained in the judgment step, wherein, the amount of the first liquid ejected in the one scan is set to smaller amounts in correspondence to fewer numbers of scans.

2. A printing method as claimed in claim 1, wherein, in said ejection amount varying step, said ejection amount of said first liquid is variably set by varying an ejection ratio versus dots on said printing medium.

3. A printing method as claimed in claim 2, wherein said number of scan is less than or equal to a predetermined value, said ejection ratio is set to zero.

4. A printing method as claimed in claim 3, wherein said number of scan exceeds said predetermined value, and said ejection ratio is set at a predetermined ratio not causing rebounding of said first or second liquid even when said second liquid is ejected on said printing medium, on which said first liquid has been ejected.

5. A printing method as claimed in claim 3, wherein said predetermined value is one.

6. A printing method as claimed in claim 3, wherein said predetermined value is an arbitrary integer greater than or equal to two.

7. A printing method as claimed in any one of claims 1 to 6, wherein said second liquid is an ink and said first liquid is a treatment liquid containing a compound making a component contained in said ink insoluble or coagulated.

8. A printing method as claimed in claim 7, wherein said component contains an anionic dye and said compound contains a cationic material consisted of a low molecular component and a polymeric component.

9. A printing method as claimed in claim 7, wherein said component contains an anionic compound and a pigment, and said compound contains a cationic material consisted of a low molecular component and a polymeric component.

10. A printing method, scanning a printing medium for ejecting first and second liquids on said printing medium for printing an image of said second liquid on said printing medium, said printing method comprising:

a step of variably setting an ejection amount of said first liquid in one scan depending upon a number of scans for a same region of said printing medium and a number of times said second liquid is ejected for a same dot in said same region, wherein, the amount of the first liquid elected in the one scan is set to smaller amounts in correspondence to fewer numbers of scans.

11. A printing method as claimed in claim 10, wherein a maximum ejection amount in said one scan of said first liquid is set to be less than or equal to a predetermined amount, and a maximum ejection ratio for said same dot in each ejection of less than or equal to said predetermined amount is set depending upon said number of scan.

12. A printing method as claimed in claim 10 or 11, wherein said second liquid is an ink and said first liquid is a treatment liquid containing a compound making a component contained in said ink insoluble or coagulated.

13. A printing method as claimed in claim 12, wherein said component contains an anionic dye and said compound contains a cationic material consisted of a low molecular component and a polymeric component.

14. A printing method as claimed in claim 12, wherein said component contains an anionic compound and a pigment, and said compound contains a cationic material consisted of a low molecular component and a polymeric component.

15. A printing apparatus, scanning a printing medium for ejecting first and second liquids on said printing medium for printing an image of said second liquid on said printing medium, said printing apparatus comprising:

judgment means for judging a number of scans for a same region of said printing medium; and ejection amount varying means for variably setting an ejection amount of said first liquid in one scan in the region depending upon said number of scans obtained by said judgment means, wherein, the amount of the first liquid elected in the one scan is set to smaller amounts in correspondence to fewer numbers of scans.

16. A printing apparatus as claimed in claim 15, wherein, said ejection amount of said first liquid is variably set by varying an ejection ratio versus dots on said printing medium, by said ejection amount varying means.

17. A printing apparatus as claimed in claim 16, wherein said number of scan is less than or equal to a predetermined value, said ejection ratio is set to zero.

18. A printing apparatus as claimed in claim 17, wherein said number of scan exceeds said predetermined value, and said ejection ratio is set at a predetermined ratio not causing rebounding of said first or second liquid even when said second liquid is ejected on said printing medium, on which said first liquid has been ejected.

19. A printing apparatus as claimed in claim 17, wherein said predetermined value is one.

20. A printing apparatus as claimed in claim 17, wherein said predetermined value is an arbitrary integer greater than or equal to two.

21. A printing apparatus as claimed in any one of claims 15 to 20, wherein said second liquid is an ink and said first liquid is a treatment liquid containing a compound making a component contained in said ink insoluble or coagulated.

22. A printing apparatus as claimed in claim 21, wherein said component contains an anionic dye and said compound contains a cationic material consisted of a low molecular component and a polymeric component.

23. A printing apparatus as claimed in claim 21, wherein said component contains an anionic compound and a pigment, and said compound contains a cationic material consisted of a low molecular component and a polymeric component.

24. A printing apparatus, scanning a printing medium for ejecting first and second liquids on said printing medium for printing an image of said second liquid on said printing medium, said printing apparatus comprising:

means for variably setting an ejection amount of said first liquid in one scan depending upon a number of scans for a same region of said printing medium and a number of times said second liquid is ejected for a same dot in said same region, wherein, the amount of the first liquid elected in the one scan is set to smaller amounts in correspondence to fewer numbers of scans.

25. A printing apparatus as claimed in claim 24, wherein a maximum ejection amount in said one scan of said first liquid is set to be less than or equal to a predetermined amount, and a maximum ejection ratio for said same dot in each ejection of less than or equal to said predetermined amount is set depending upon said number of scan by said means.

26. A printing apparatus as claimed in claim 24 or 25, wherein said second liquid is an ink and said first liquid is a treatment liquid containing a compound making a component contained in said ink insoluble or coagulated.

27. A printing apparatus as claimed in claim 26, wherein said component contains an anionic dye and said compound contains a cationic material consisted of a low molecular component and a polymeric component.

28. A printing apparatus as claimed in claim 26, wherein said component contains an anionic compound and a pigment, and said compound contains a cationic material consisted of a low molecular component and a polymeric component.

29. A printing method for printing an image on a printing medium by ejecting a first liquid and a second liquid from a printing head to said printing medium while relatively scanning said printing head and said printing medium, the method comprising:

ejecting said first liquid and said second liquid from said printing head to said printing medium depending upon a printing mode selected from among a plurality of printing modes in which a number of scans for a same region on said printing medium is different for each printing mode;

wherein, an ejection ratio of said first liquid to a number of ink dots ejected for all scans of the printing medium in the printing mode selected is smaller in correspondence to fewer numbers of scans.

30. A printing method as claimed in claim 29, wherein said second liquid is an ink and said first liquid contains a component improving an image quality of said second liquid.

31. A printing method ad claimed in claim 29, wherein said second liquid is an ink and said first liquid contains a component making a coloring agent in said second liquid insoluble or coagulated.

32. A printing apparatus having means for printing an image on a printing medium with ejecting a first liquid and a second liquid from a printing head to said printing medium while relatively scanning said printing head and said printing medium, comprising:

printing means for ejecting said first liquid and said second liquid from said printing head to said printing medium depending upon a printing mode selected from among a plurality of printing modes in which a number of scans for a same region of said printing medium is different for each printing mode, wherein, an ejection ratio of said first liquid to a number of ink dots ejected for all scans of the printing medium in the printing mode selected is smaller in correspondence to fewer numbers of scans.

33. A printing apparatus as claimed in claim 32, wherein said second liquid is an ink and said first liquid contains a component improving an image quality of said second liquid.

34. A printing apparatus as claimed in claim 32, wherein said second liquid is an ink and said first liquid contains a component making a coloring agent in said liquid insoluble or coagulated.

* * * * *

UNITED STATES PATENT AND TRADEMARK OFFICE

CERTIFICATE OF CORRECTION

PATENT NO. : 6,145,978
DATED : November 14, 2000
INVENTOR(S) : Kato et al.

It is certified that error appears in the above-identified patent and that said Letters Patent is hereby corrected as shown below:

Title page,
Item [57], ABSTRACT,
Line 4, “scan” should read -- scans --.

Column 1,
Line 7, “fereinto” should read -- hereinto --;
Line 31, “both of” should read -- both --;
Line 39, “Such” should read -- Since such --; and
Line 43, “complicate,” should read -- complicated --.

Column 3,
Line 6, “A product” should read -- If a product --;
Line 10, “more” should read -- a --;
Line 11, “case” should read -- case, --;
Line 14, “provided” should read -- providing --; and
Line 49, insert -- a -- before “smaller”.

Column 4,
Line 60, “a ejecting” should read -- an ejecting --; and
Line 62, “to a” should read -- to as a --.

Column 5,
Line 10, delete “of”; and
Line 11, “M ink” should read -- a M ink --.

Column 6,
Line 25, “small to” should read -- small so as to --; and
Line 42, “ejection” should read -- ejecting --.

Column 7,
Line 19, “illustration” should read -- illustrations --; and
Line 59, “both of” should read -- both --.

UNITED STATES PATENT AND TRADEMARK OFFICE

CERTIFICATE OF CORRECTION

PATENT NO. : 6,145,978
DATED : November 14, 2000
INVENTOR(S) : Kato et al.

It is certified that error appears in the above-identified patent and that said Letters Patent is hereby corrected as shown below:

Column 9,
Line 15, “is not” should read -- are not --;
Line 56, “arbitrarily” should read -- arbitrary --; and
Line 60, “integer” should read -- an integer --.

Column 10,
Line 40, “illustration” should read -- illustrations --; and
Line 51, “degradate” should read -- degrade --.

Column 11,
Line 40, “example” should read -- an example --;
Line 45, “twice of scanning” should read -- scanning twice --; and
Line 54, “checkered” should read -- a checkered --.

Column 12,
Line 26, “scan” should read -- scans --;
Line 28, “scanning.” should read -- scans. --;
Line 30, “scan.” should read -- scans. --;
Line 35, “determinating” should read -- determining --; and
Line 50, “scan,” should read -- scans, -- and “time” should read -- times --.

Column 13,
Line 10, “scan” should read -- scans --; and
Line 56, “Laying-open” should read -- Laid-open --.

Column 14,
Line 48, “rise” should read -- to rise --;
Line 54, “Laying-open” should read -- Laid-open --; and
Line 65, “scanning” should read -- scans --.

Column 15,
Line 5, “complicate” should read -- complicated --; and
Line 18, “form” should read -- from --.

UNITED STATES PATENT AND TRADEMARK OFFICE

CERTIFICATE OF CORRECTION

PATENT NO. : 6,145,978
DATED : November 14, 2000
INVENTOR(S) : Kato et al.

It is certified that error appears in the above-identified patent and that said Letters Patent is hereby corrected as shown below:

Column 16,
Line 43, “elected” should read -- ejected --.

Column 17,
Line 19, “elected” should read -- ejected --.

Column 18,
Line 16, “ad claimed” should read -- as claimed --.

Signed and Sealed this

Eighteenth Day of June, 2002

*Attest:*

*Attesting Officer*

JAMES E. ROGAN
*Director of the United States Patent and Trademark Office*